US008381669B2

(12) United States Patent
Breivik et al.

(10) Patent No.: US 8,381,669 B2
(45) Date of Patent: Feb. 26, 2013

(54) SYSTEM FOR LOADING OF HYDROCARBONS FROM A FLOATING VESSEL

(75) Inventors: Kåre G. Breivik, Tau (NO); Harald Kleppestø, Bryne (NO)

(73) Assignee: Statoilhydro ASA, Stavanger (NO)

( * ) Notice: Subject to any disclaimer, the term of this patent is extended or adjusted under 35 U.S.C. 154(b) by 163 days.

(21) Appl. No.: 12/529,793

(22) PCT Filed: Mar. 17, 2008

(86) PCT No.: PCT/NO2008/000101

§ 371 (c)(1),
(2), (4) Date: Nov. 6, 2009

(87) PCT Pub. No.: WO2008/127118

PCT Pub. Date: Oct. 23, 2008

(65) Prior Publication Data

US 2010/0101473 A1 Apr. 29, 2010

(30) Foreign Application Priority Data

Mar. 20, 2007 (NO) ..... 20071488

(51) Int. Cl.
*B65D 88/78* (2006.01)

(52) U.S. Cl. ..... 114/256

(58) Field of Classification Search .. 114/230.12–230.2, 114/263–267, 293, 5, 8, 256, 258; 441/3–5; 405/195.1, 201, 202, 224
See application file for complete search history.

(56) References Cited

U.S. PATENT DOCUMENTS

| | | | | |
|---|---|---|---|---|
| 3,735,435 | A | 5/1973 | Mikulicic et al. | |
| 6,200,180 | B1 * | 3/2001 | Hooper | 441/5 |
| 6,983,712 | B2 | 1/2006 | Cottrell et al. | |
| 7,581,508 | B2 * | 9/2009 | Giles | 114/289 |

FOREIGN PATENT DOCUMENTS

| | | | |
|---|---|---|---|
| EP | 1705111 | B1 | 8/2007 |
| FR | 2576577 | A1 * | 8/1986 |
| GB | 2390351 | A | 1/2004 |
| WO | 0064732 | A1 | 11/2000 |
| WO | 0100482 | A1 | 1/2001 |

OTHER PUBLICATIONS

EPO Machine Translation of FR 2576577 dated Aug. 1986 to Leon Frohly, 4 pages.

* cited by examiner

*Primary Examiner* — Daniel Venne
*Assistant Examiner* — Anthony Wiest
(74) *Attorney, Agent, or Firm* — Rothwell, Figg, Ernst & Manbeck, p.c.

(57) ABSTRACT

The invention relates to a system for loading of hydrocarbons from a floating vessel, such as a FPSO or FSO vessel, to an export tanker, where the floating vessel is spread moored to a sea bottom, and where the export tanker during the loading phase is moored in such a way that the export vessel to a greater or less degree can weathervane dependent upon the prevailing weather, wave and/or wind conditions.
According to invention the floating vessel at least at one end is provided with a rotatable deck which can be turned when the heading of the export tanker changes.

12 Claims, 6 Drawing Sheets

SYSTEM FOR LOADING OF HYDROCARBONS FROM A FLOATING VESSEL

CROSS REFERENCE TO RELATED APPLICATION(S)

This application is a 35 U.S.C. §371 National Phase Entry Application from PCT/NO2008/000101, filed Mar. 17, 2008, and designating the United States. This application also claims the benefit of Norwegian Patent Application No. 20071488 filed Mar. 20, 2007, the disclosure of which is incorporated herein in its entirety by reference.

AREA OF THE INVENTION

The present invention relates to a system for off-loading of hydrocarbons from a floating vessel, such as a FPSO or FSO vessel, to an export tanker, where the floating vessel is spread moored to a sea bed, and where the export tanker during the loading phase is moored in such a way that the export vessel to a certain degree may weathervane dependent upon the prevailing weather, wave and/or wind directions.

BACKGROUND OF THE INVENTION

In areas with low wave heights typically below 5 metres significant in a 100-year condition, it is often advantageous to use a so-called spread mooring instead of a turret mooring for the production vessel (FPSO) and a storage vessel (FSO).

Spread mooring means that the FPSO/FSO vessel cannot weathervane if the environmental forces caused by waves, wind and stream changes direction. This further means that the offloading of oil from the tanker often is not feasible in tandem configuration since the vessels will have different heading. Tandem configuration means that the vessels are positioned in a row with mooring rope extending between the bow on the export tanker and the aft end of the FPSO/FSO unit.

Today, export of oil from spread moored FPSO/FSO vessel often takes place via a so-called CALM buoy (Catenary Anchor Leg Mooring) which typically is positioned at a distance of two to three kilometres from the FPSO/FSO vessel. At large water depths typically from 800 metres and more, the cost for such systems will be in the order of NOK 1.000-1.500 millions. This entails large extra cost both related to the purchase of buoy, mooring, hosing and exporter from the FPSO/FSO unit to the export buoy, but also with respect to operation and maintenance.

U.S. Pat. No. 6,983,712 discloses an oil loading system and a mooring system between a floating production, storage and offloading vessel (FPSO), moored in deep water by so-called spread mooring, and a shuttle tanker moving between a terminal and the moored FSPO. A submerged yoke has one end coupled to the moored FSPO, while a buoy extending through the sea surface is moored to the opposite end of the yoke. At its middle area the yoke is moored to the sea bottom by a chain. The export tanker is rotatably moored to the buoy such that the tanker is allowed to turn dependent upon the prevailing wind, wave and stream conditions. In the loading and mooring system a mooring rope and a hose for transfer of hydrocarbons extend from the buoy to the bow of the tanker. Today export of oil from spread moored FPSO/FSO vessels typically takes place via a so-called CALM buoy which typically is placed at a distance of two to three kilometres from the FPSO/FSO vessel. At large water depth the cost for such systems will be in the order of NOK 800-1.000 million.

GENERAL DESCRIPTION OF THE INVENTION

An object of the invention is to provide a system for loading of oil which is safe, efficient and cost optimal, and where the risk for oil spill, e.g. as a consequence of the prevailing environmental forces, is reduced to a minimum.

A further object of the invention is to provide a system which facilitates simple mooring of an export tanker to a moored FPSO/FSO vessel.

A further object of the invention is to provide a safe loading system which advantageously could be used both for spread moored FPSO/FSO units, but also for other fixed moored devices used in the offshore oil industry. The advantages are achieved by a solution which is described in more detail in the characterizing part of the independent claim 1, read in conjunction with the preamble of the independent claim.

An essential advantage of the solution according to the invention is the economical advantages obtained by the new system. Further the solution is not influenced economically by the sea depth of the actual field and will typically cost approximately NOK 100 millions completed and installed with two loading hoses on drum, that is approximately 1/10 of the cost of the most commonly used CALM loading buoy.

Additionally there will be substantial savings related to operation and maintenance. The savings may be in order of NOK 30-50 millions per year. Additionally savings related to a shorter loading time with two floating hoses will be approximately NON 25 millions per year, such that the total savings related to operation and maintenance will be in the order of NOK 50-75 millions per year.

Another advantage of the present invention compared to traditional solutions, is that all equipment may be placed on board the FPSO/FSO vessel and is easily available for continuous inspection and maintenance.

If loading system is installed fore and aft the operational window will cover 360 degrees and in addition contribute to extra operational reliability and applicability. This further contributes to high loading regularity, reliability and efficiency under different operational conditions.

BRIEF DESCRIPTION OF THE DRAWINGS

In the following the present invention is described more closely in the form of different embodiments and referring to the attached drawings where:

As an introduction it should be mentioned that the same reference numbers are used for the same main components used in connection with the different embodiments shown in the figures.

FIG. 1 shows a schematic view of a FPSO/FSO unit 10 seen from above. The unit 10 is moored to the sea bottom (not shown) in such a way that the FPSO/FSO unit 10 is not allowed to weathervane in accordance with the environmental forces (spread moored). Since such a form of mooring is well known to a person skilled in the art, it is not described in detail. According to the embodiment shown in FIG. 1, the unit 10 is provided with a rotatable deck or rotary table 11 both at aft end and bow of the units 10. Two hose drums 12, each of which for example being able to store 350 metres floating hose 13 and for example having a diameter of 20", are arranged at the one and/or the other rotatable deck 11. A mooring winch 14 which is designed for handling one, possibly two hawsers 15, is also installed on one or both of the two rotatable decks 11.

As shown in FIG. 1 an export tanker 16 is moored to one end of the FPSO/FSO unit 10 by the mooring hawser 15 from the mooring winch 14. This extends from one end of the unit 10 to the bow of the export tanker, which for this purpose is equipped with a conventional mooring arrangement. Since such a mooring arrangement is well know to a person skilled in the art, this is not shown.

A towing vessel 17 is coupled to the aft end of the export tanker 16 by a mooring line 18. The towing vessel 17 normally is coupled to the export tanker 16 at any time to secure that the heading and the position is optimal/safe with respect to the FPSO/FSO vessel 10.

Figure 1:
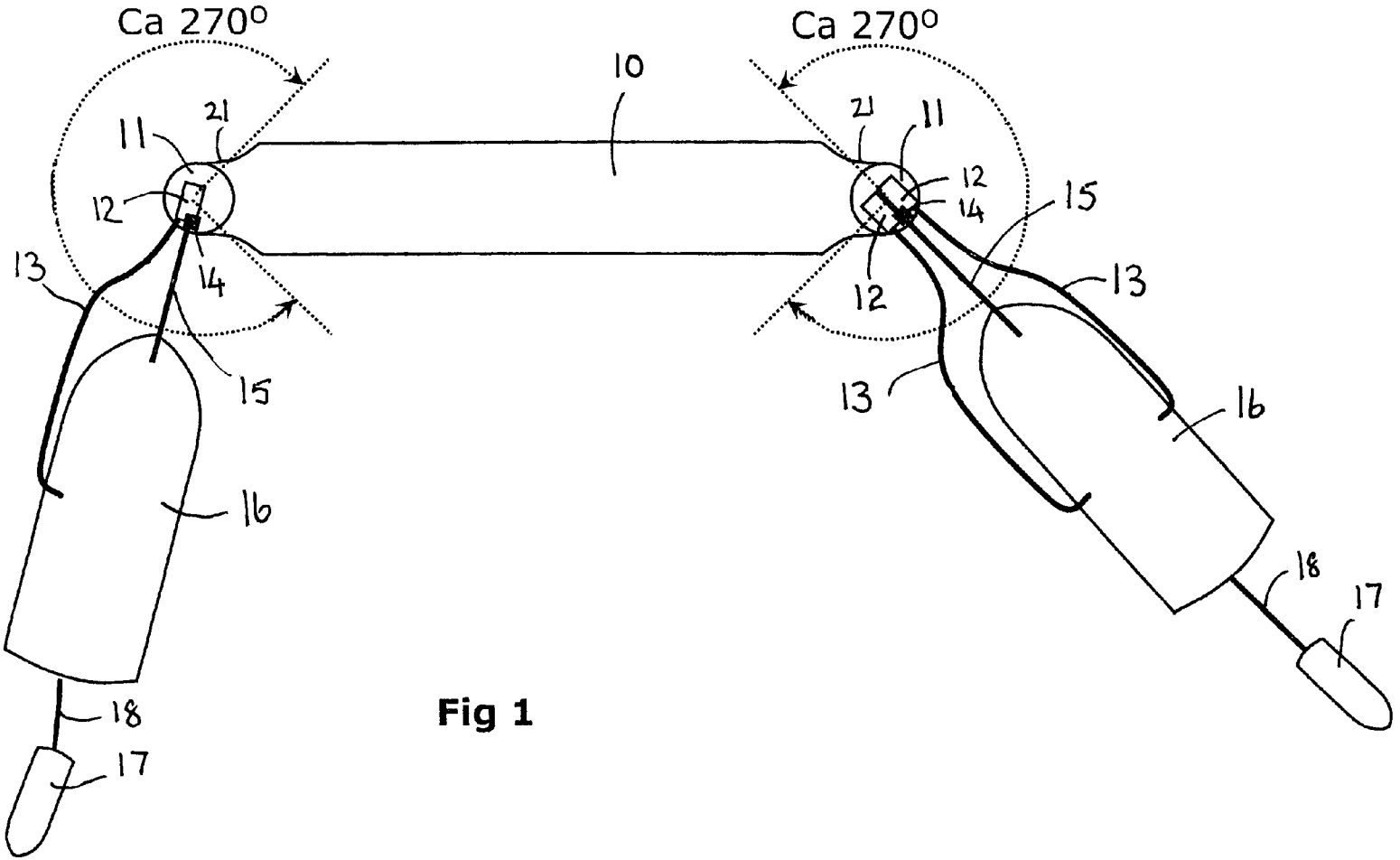
FIG. 1 shows the invention used in connection with a typical arrangement using hose drums.

According to the embodiment shown in FIG. 1 two floating hoses 13 extend from the hose drums 12 on the rotatable deck 11 at the end of the FPSO/FSO to the bow of the export tanker 16, the floating hoses 13 being taken onboard and coupled midship of the export tanker 16. FIG. 1 also shows a variant of the embodiment where only one floating hose 13 and one hose drum 12 are used. This embodiment is shown at the opposite end of the FPSO/FSO vessel 10.

As will be evident from the figure the operational window for the export tanker 16 will be approximately +/−135 degrees relative to the fixed heading of the FPSO/FSO vessel 10, i.e. totally approximately 270 degrees.

The arrangement show in FIG. 1 will function as follows:

The export tanker 16 is arriving against prevailing weather direction with the towing vessel 17 coupled to the aft end. At a distance of approximately 150 metres from the FPSO/FSO vessel 10 the export tanker 16 stops and the hawser 15 is transferred by a lead-in-line from the FPSO/FSO vessel to the export tanker 16. The export tanker 16 is then manoeuvred in a controlled manner towards the FPSO/FSO vessel. Approximately 120 metres from the FPSO/FSO vessel the export tanker stops and the mooring hawser 15 is drawn on board and fastened to the mooring arrangement (not shown) at the bow of the export tanker 16. As described above the towing vessel 17 will normally be coupled to the tanker at all times.

When the prevailing weather conditions turn, the rotatable deck 11 with mooring winch 14 and the loading hose drum 12 will be turned such that hawser(s) 15 and loading hose(s) 13 at any time have optimal direction with respect to the heading of the export tanker 16.

If the weather forces should turn completely, this procedure is reversed and the export tanker is manoeuvred accordance with a corresponding procedure to the opposite end of the FPSO/FSO vessel. This is a possible embodiment if the systems are installed at the both ends of the vessel.

Upon completion of the loading operation, the hoses are emptied, by way of example using nitrogen, such that remaining oil is guided to the tanks of the export tanker 16. Thereupon the hoses 13 are disconnected from the midship manifold (not shown) of the export tanker 16 and rolled up on their respective drums 12. It is also possible to send a pig through the hose in order to remove oil deposits which may have settled on the interior wall of the hose during previous use. This might take place in different ways with and without the export tanker being coupled.

If necessary in a case of emergency, both hose(s) and hawser may be disconnected from the FPSO/FSO vessel. The towing vessel may then freely tow the export tanker away. A valve at the end of the hose(s) will be closed prior to uncoupling and thereby hinder oil spill.

When the loading operation is completed, the export tanker 16 is disconnected from the mooring hawser(s) 15 and the loading trip towards harbour may start.

It should be noted the hose(s) 13 alternatively may be stored floating at the sea surface (not shown).

Figure 2:
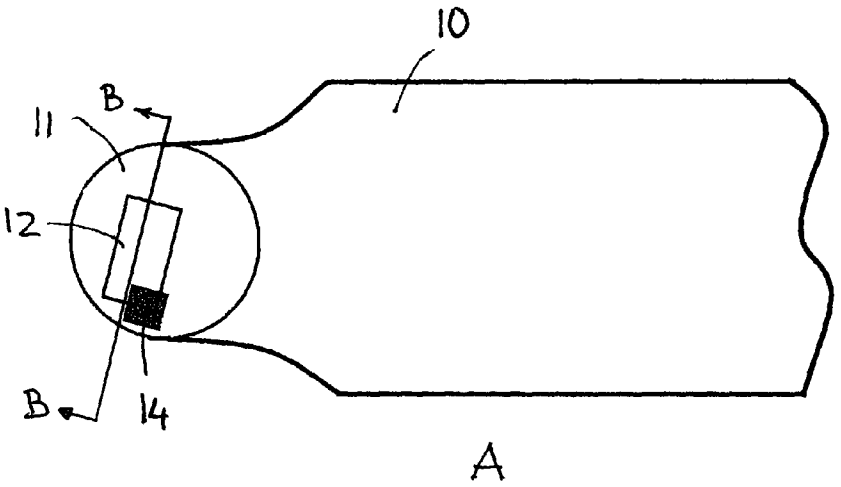
FIG. 2*a* shows schematically one end of a FPSO/FSO vessel.
FIG. 2*b* shows schematic details of the construction of the rotatable deck according to the invention, with a hose drum or hose drums mounted, and with a mooring winch.
Figure 2:
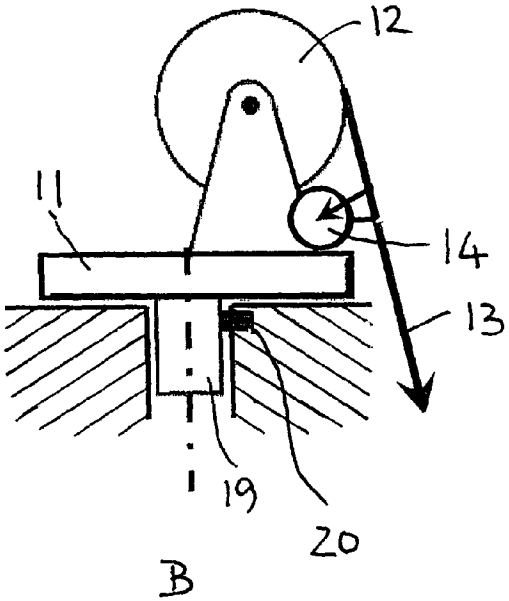

FIG. 2*a* shows schematically the end of FPSO/FSO vessel equipped with a rotatable deck 11 or rotary table according to the invention. As described above this is comprises a hose drum 12 and a mooring winch.

FIG. 2*b* shows schematically a vertical section through the rotatable deck 11 seen along the line B-B in FIG. 2*a*. As schematically illustrated the rotatable deck 11 is rotatably mounted on a vertical shaft 19 which is supported by a bearing (not shown), arranged in the deck of the vessel 10. For clarity the bearing in the deck of the vessel is not shown. The bearing may be of any conventional type well known to a person skilled in the art. In connection with the shaft 19 a motor 20 is arranged to operate the rotatable deck.

Figure 3:
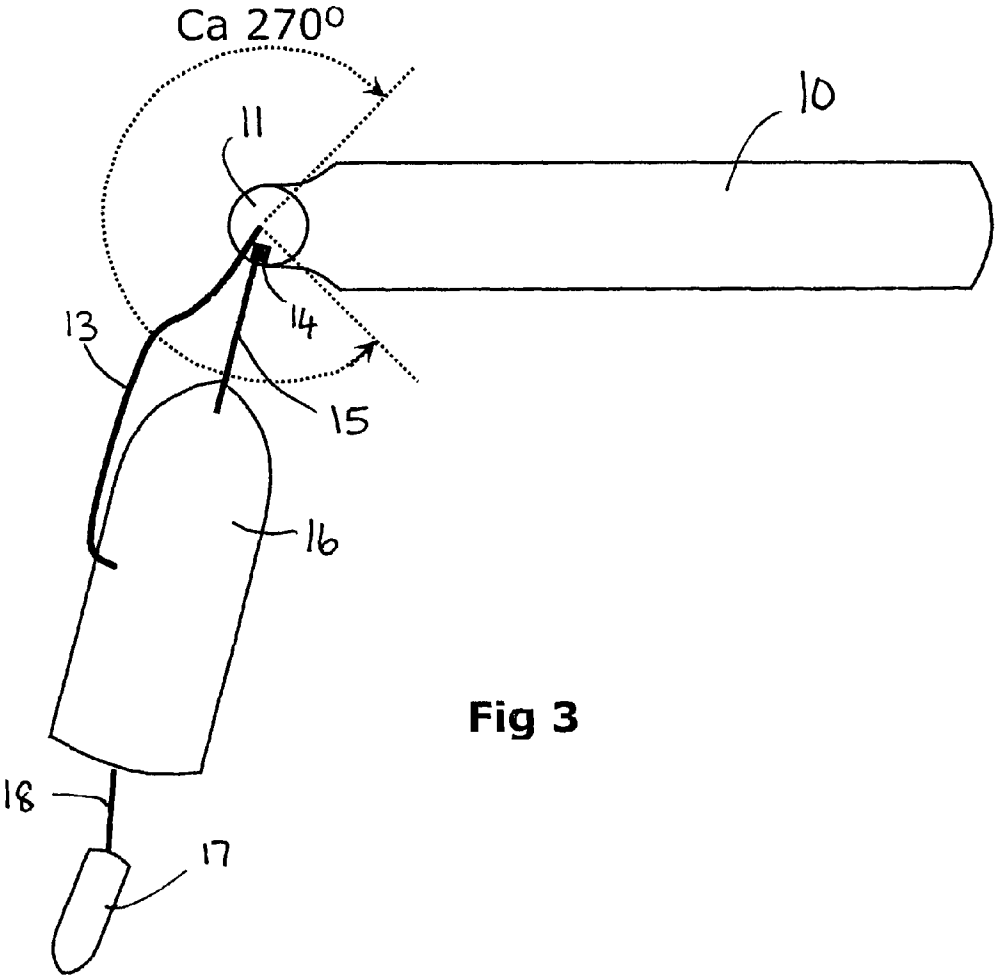
FIG. 3 shows a typical arrangement with hose(s) floating in the sea after loading.

FIG. 3 shows schematically a second embodiment of the invention where the FPSO/FSO vessel 10 is provided with a rotatable deck 11 only at one end which is the bow of the vessel 10. Further only one drum 12 and one floating hose 13 are used according to this embodiment. It should be noted that the rotatable deck 11 may be arranged at the aft end of the vessel 10 without deviating from the inventive idea.

Figure 4:
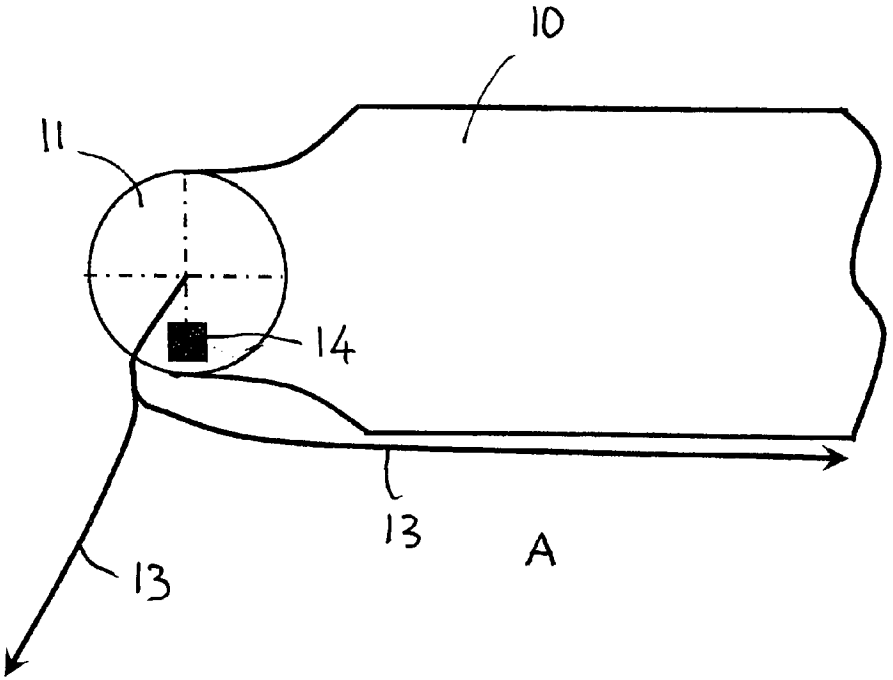
FIG. 4*a* shows schematically the one end of a FPSO/FSO vessel, showing details of the hose(s) floating in the sea after loading.
FIG. 4*b* shows schematic details of the construction of a rotatable deck according to an embodiment of the invention.
Figure 4:
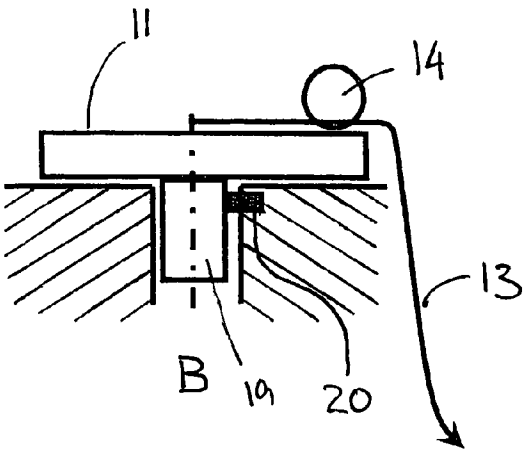

FIG. 4 shows schematically a further embodiment where the FPSOL/FSO vessel 10 is provided with a rotatable deck 11, constructed as described in connection with the FIGS. 2*a* and 2*b*, and where the loading hose is not coupled to the vessel 10 via a hose drum 12, but via a swivel device (not shown).

Figure 5:
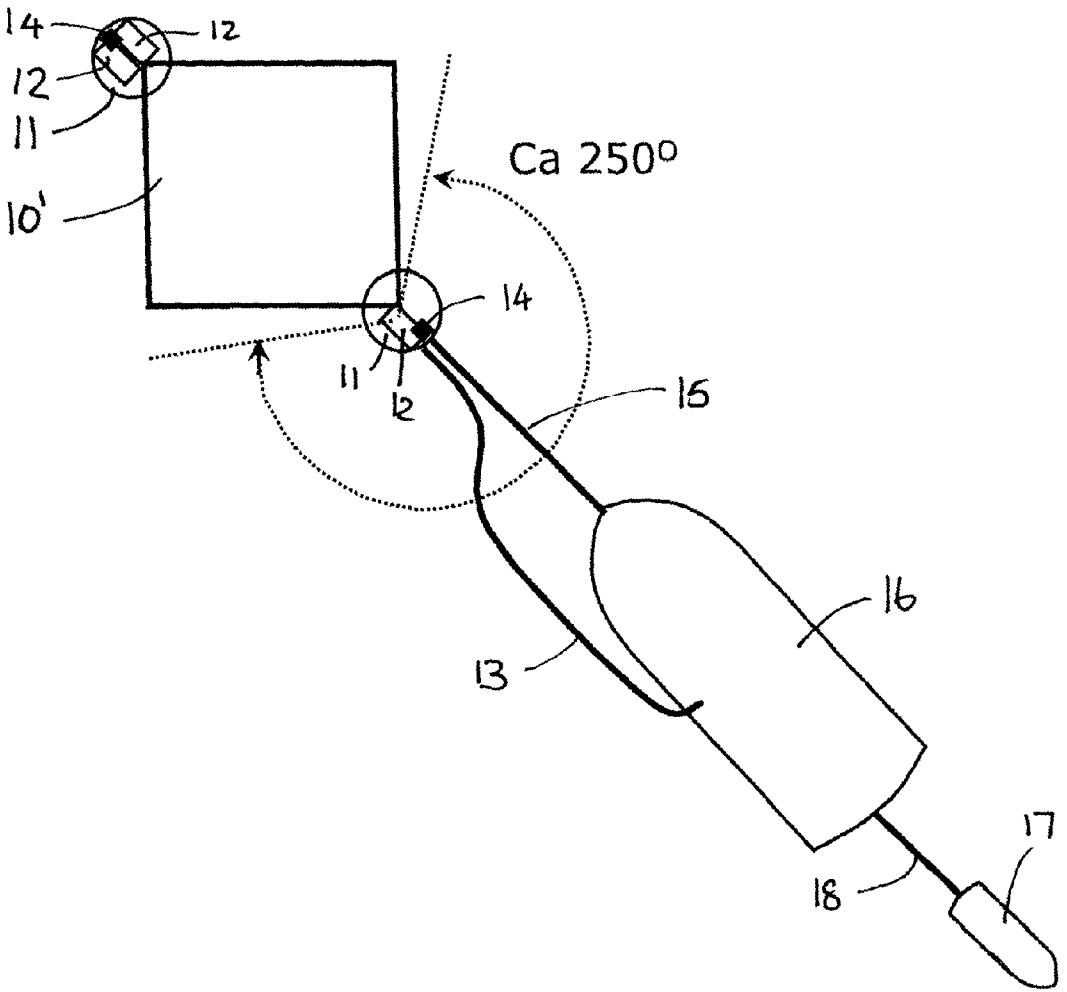
FIG. 5 shows typical arrangement for loading from platform.

FIG. 5 shows schematically an embodiment where the export tanker 16 is moored to a platform 10', two diamentrally placed corners of the deck being provided with a corresponding rotatable deck 11, having one or more hose drums 12 and mooring winch(s) 14. The construction of the rotatable deck 11, the mode of operation of the deck 11 and the procedure for mooring the export vessel 16 to the platform correspond to the procedure described above.

Figure 6:
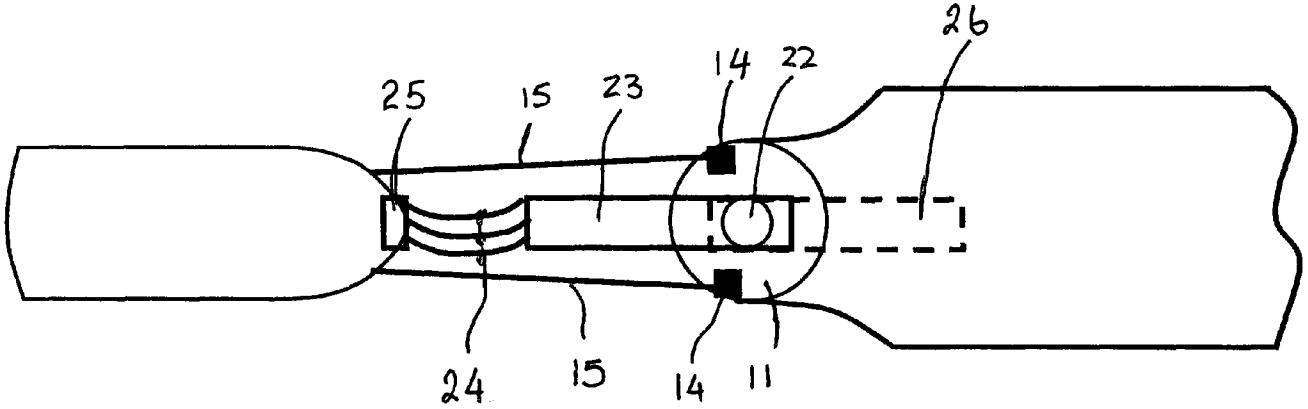
FIG. 6 shows a typical arrangement with loading tower and boom for loading of LNG to dedicated export tankers where the LNG hose is coupled to the dedicated bow manifolds of the vessel.

FIG. 6 shows a solution specially adapted to LNG loading. The loading tower 22 is installed at the centre of the rotatable table 11 and will thus be able at any time to direct the boom 23 towards the bow of the tanker 16, where the LNG hoses 24 are coupled to the bow manifold 2 of the vessel 16. When the loading operation is completed, the rotatable table 11 can be rotated approximately 180 degrees, such that the loading boom 23 and the hoses 24 are directed to a position 26 towards the deck of said FPSO/FSO. Thereby the hoses 24 may be emptied as required towards a fixed tube system (not shown), the equipment may be inspected and maintained, etc. Mooring hawsers 15 and mooring winches are as presented above with respect to the previously shown embodiments.

The nose/tail structure 21 of the FPSO/FSO vessel is specially designed with respect to the rotatable mooring and loading system described above. The width of the nose/tail structure 21 will typically be ⅓-½ of the width of the FPSO/FSO vessel. The inclined ship hull side between the main hull, i.e. the parallel part of the hull (the main beam), and the nose/tail structure 21 will allow a largest possible area of operation for the export tanker 16.

The rotatable deck 11 with belonging equipment 12,14 may for example be supplied as a completed and tested unit which is lifted on board the FPSO/FSO vessel 10 or platform 10'. The unit may practically be mounted on bearings in the underlying nose/tail structure 21 and may be turned by e.g. hydraulic motors 20. Uncoupling will also be possible such that the rotatable deck 11 may be able to follow the turning movements of the export tanker 16.

In the figures there is shown an arrangement which comprises two hose drums 12. Other variants are of course also possible, but with two loading drums 12 the loading rate could be doubled, which is very advantageous in order to minimize the loading time.

It should also be noted that the solution according to the invention in a simple manner may be adapted to both loading of oil, LNG and hydrocarbon products, possibly also in combination.

The loading system according to the invention is adaptable both to new and existing FPSO/FSO vessels. The system may also be adapted different types of platforms. If necessary, different combinations of loading hoses may be arranged for respectively oil and LNG/hydrocarbon products.

Even if the hose drum 12 is said to typically be able to store 350 metres of floating hose 13 with a diameter of 20", it should be noted that it would be obvious for a person skilled in the art that the hose drum 12 may have any storage capacity and that the floating hose 13 may have any practical diameter without deviating from the invention.

A loading rate using double floating hoses 13 may typically be approximately 13.000-15.000 $m^3$/h.

The loading system according to invention may be prefabricated and installed as complete modules on board the FPSO/FSO vessel.

The rotatable deck may at one end of said FPSO or FSO vessel possibly be arranged in a sideways displaced position with respect to the main beam of the vessel. For such a solution the operational angle of the loading operation will be in the order of 120 degrees to one side, relative to the hull side, without conflicting with the ship side of said FSPO/FSO vessel. Mooring hawsers and loading hoses may in this case be arranged e.g. as indicated in FIG. 1. Also for this solution spread mooring is applied. Such a laterally displaced rotatable deck may e.g. be advantageous in waters where the prevailing weather conditions are such that more or less powerful sudden gusts may arrive at up to 90 degrees relative to possible swell, and where the trade wind may come in obliquely from the opposite side of the gusts and possibly obliquely to the direction of said swell. Such weather conditions may be experienced e.g. at the coast of Nigeria.

The invention claimed is:

1. A floating storage and offloading (FSO) or floating production, storage and offloading (FPSO) vessel comprising:
- a main beam;
- a bow end;
- an aft end; and
- a nose/tail structure provided at one of the bow and aft ends, wherein the nose/tail structure has:
  - a maximum width between ⅓ and ½ of a maximum width of the main beam of the FSO or FPSO vessel, and
  - a rotatable deck or table capable of allowing an export tanker to moor to said rotatable deck or table, and capable of turning about an axis that is substantially vertical and transverse to the longitudinal axis of the FSO or FPSO vessel in the event of weathervaning of the export tanker;
- wherein the FSO or FPSO vessel is spread moored to a sea bottom.

2. The FSO or FPSO vessel of claim 1, wherein the rotatable deck or table is arranged along the longitudinal axis of the FSO or FPSO vessel.

3. The FSO or FPSO vessel of claim 1, wherein a bow and/or stern area of said FSO or FPSO vessel has downwards and inwards inclined ship sides between the main beam and the respective tail and nose parts on which the actual rotatable deck or table with equipment is mounted.

4. The FSO or FPSO vessel of claim 1, further comprising:
- a second nose/tail structure provided at the other of the bow and aft ends, wherein the nose/tail structure has:
  - a maximum width between ⅓ and ½ of the maximum width of the main beam of the FSO or FPSO vessel, and
  - a second rotatable deck or table capable of allowing a second export tanker to moor to said second rotatable deck or table, and capable of turning about an axis that is substantially vertical and transverse to the longitudinal axis of the FSO or FPSO vessel in the event of weathervaning of the second export tanker;
- wherein the rotatable deck or table of the nose/tail structure and second rotatable deck or table of the second nose/tail structure enable loading to be performed independent of the direction of the prevailing weather, wave and/or wind conditions.

5. The FSO or FPSO vessel of claim 1, wherein the rotatable deck or table is allowed to turn up to approximately +/−135 degrees relative to the longitudinal axis of the FSO or FPSO vessel.

6. The FSO or FPSO vessel of claim 1, further comprising at least one hose drum that is for a transmission hose and arranged on the rotatable deck or table.

7. The FSO or FPSO vessel of claim 1, further comprising at least one mooring winch arranged at the rotatable deck or table.

8. The FSO or FPSO vessel of claim 1, further comprising inclined ship sides between the main beam and the nose/tail structure, wherein the inclined ship sides converge towards each other in a direction from the main beam to the nose/tail structure.

9. The FSO or FPSO vessel of claim 8, wherein the main beam comprises port and starboard sides that are parallel to the longitudinal axis of the FSO or FPSO vessel, and the inclined ship sides converge towards the longitudinal axis of the FSO or FPSO vessel in a direction from the main beam to the nose/tail structure.

10. The FSO or FPSO vessel of claim 8, wherein the nose/tail structure and the inclined ship sides are mutually configured to provide an operational window for an export tanker moored to the rotatable deck or table of approximately +/−135 degrees relative to the longitudinal axis of the FSO or FPSO vessel.

11. The FSO or FPSO vessel of claim 1, wherein the FSO or FPSO vessel has an elongate shape.

12. A system for loading hydrocarbons from the floating FPSO or FSO vessel of claim 1 to an export tanker, the system comprising:

the floating FPSO or FSO vessel wherein the FSO or FPSO vessel is spread moored to a sea bottom; and the export tanker;

wherein:

the export tanker is moored to the rotatable deck or table of the floating FPSO or FSO vessel in such a way that the export vessel is permitted to weathervane relative to the floating FPSO or FSO vessel dependent upon the prevailing weather, wave, and/or wind conditions;

the rotatable deck or table is configured to turn relative to the longitudinal axis of the FSO or FPSO vessel when a heading of the export tanker changes due to weathervaning; and the floating FPSO or FSO vessel is configured to load hydrocarbons to the export tanker while the export tanker is moored to the rotatable deck or table of the floating FPSO or FSO vessel.

* * * * *

UNITED STATES PATENT AND TRADEMARK OFFICE

CERTIFICATE OF CORRECTION

PATENT NO. : 8,381,669 B2
APPLICATION NO. : 12/529793
DATED : February 26, 2013
INVENTOR(S) : Breivik et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 209 days.

Signed and Sealed this
Eighteenth Day of November, 2014

Michelle K. Lee

Michelle K. Lee
*Deputy Director of the United States Patent and Trademark Office*